US006110865A

United States Patent [19]

Hayashi et al.

[11] Patent Number: 6,110,865

[45] Date of Patent: Aug. 29, 2000

[54] RECORDING COMPOSITE SHEET

[75] Inventors: Shigeo Hayashi, Kawasaki; Toshikazu Onishi; Koji Narita, both of Yokohama; Ryuichi Kisaka, Urawa, all of Japan

[73] Assignee: Oji Paper Co., Ltd., Tokyo, Japan

[21] Appl. No.: 09/034,385

[22] Filed: Mar. 4, 1998

[30] Foreign Application Priority Data

Sep. 5, 1997 [JP] Japan ..... 9-241393

[51] Int. Cl.[7] ..... B41M 5/035; B41M 5/38

[52] U.S. Cl. ..... 503/227; 428/913; 428/914

[58] Field of Search ..... 428/195, 913, 428/914; 8/471; 503/227

[56] References Cited

U.S. PATENT DOCUMENTS

| | | | |
|---|---|---|---|
| 4,778,782 | 10/1988 | Ito et al. | 503/227 |
| 4,886,775 | 12/1989 | Kubodera et al. | 503/227 |
| 4,984,823 | 1/1991 | Ishii et al. | 283/81 |
| 5,001,106 | 3/1991 | Egashira et al. | 503/227 |
| 5,006,502 | 4/1991 | Fujimura et al. | 503/227 |
| 5,244,861 | 9/1993 | Campbell et al. | 503/227 |
| 5,514,435 | 5/1996 | Suzuki et al. | 428/40 |

FOREIGN PATENT DOCUMENTS

| | | | |
|---|---|---|---|
| 0 283 048 A2 | 9/1988 | European Pat. Off. | 503/227 |
| 0 288 568 A1 | 11/1988 | European Pat. Off. | 503/227 |
| 0 764 547 A2 | 3/1997 | European Pat. Off. | 503/227 |
| 0 807 533 A2 | 11/1997 | European Pat. Off. | 503/227 |
| 4-341885 | 11/1992 | Japan | 428/195 |

*Primary Examiner*—Bruce H. Hess
*Attorney, Agent, or Firm*—Arent Fox Kintner Plotkin & Kahn PLLC

[57] ABSTRACT

A recording composite sheet capable of being separated into two sheet sections comprises a first sheet section (2) having a first recording layer (5) formed on a front surface of a first support sheet (4) and a second sheet section (3) comprising a second support sheet (7) and bonded to the first sheet sections to an extent that the bonded sheet sections are separable from each other by hand.

18 Claims, 3 Drawing Sheets

RECORDING COMPOSITE SHEET

BACKGROUND OF THE INVENTION (1) Field of the Invention

The present invention relates to a recording composite sheet. More particularly, the present invention relates to a recording composite sheet capable of being easily and stably printed and having two sheet sections bonded to each other and separable from each other by hand as desired.

(2) Description of the Related Art

As means for recording information in colored images, various systems, for example, an electrophotographic recording system, an ink jet recording system, a thermal transfer recording system and a thermosensitive recording system are available. Among these systems, the thermal transfer recording system and ink jet recording system can record full color clear images and thus are attractive.

In the thermal transfer recording system, a sublimating dye-contacting layer or a thermally melting ink-containing layer of an ink sheet is brought into contact with a dye or ink melt-receiving layer of a recording sheet, the superposed sheets are heated imagewise by heating means, for example, a thermal head, so as to thermally transfer imagewise the dye or ink melt to the image-receiving layer and to form dye or ink colored images having a desired form and color density on the ink-receiving layer.

The dye or ink-containing sheet contains yellow, magenta, cyan or optionally black-colored dye or ink.

Full colored images can be formed by superposing the above-mentioned colored images having a desired form and color density on each other. The above-mentioned thermal transfer recording sheets are expected to be widely utilized to record clear full colored images.

In the ink jet recording system, inks can be jetted imagewise toward an ink-receiving layer of an ink jet recording sheet through ink-jetting means incorporated to an ink jet printer. In the ink jet recording system, clear full colored images can be formed by using a plurality of colored inks different in hue from each other. Therefore, the ink jet recording system is expected to be widely utilized in various full-colored image-recording fields. As mentioned above, with advance and spread of the printing technology, various requirements are applied to the recording sheets. For example, those are demands of providing a thin recording sheet having a thickness of 100 $\mu$m or less, particularly 60 $\mu$m or less, usable, without difficulty, for above-mentioned recording systems; a recording composite sheet capable of being printed on the front and back surfaces thereof and being separated into a front sheet section and a back sheet section by hand; and a recording composite sheet capable of containing visible images in an invisible inside part of the sheet, and of being separated, by hand, into a front sheet section and a back sheet section to thereby make appear the visible images contained in at least one of the sheet sections.

Usually, in the conventional composite sheet, the front sheet section and the back sheet sections are bonded to each other through a pressure-sensitive adhesive layer. When the conventional composite sheet is peeled into the two sheet sections, at least one of the sheet sections has the pressure-sensitive adhesive layer.

The conventional composite sheet is unsuitable for the use in which the separated sheet sections should have no pressure-sensitive adhesive surfaces.

SUMMARY OF THE INVENTION

An object of the present invention is to provide a recording composite sheet having no pressure-sensitive adhesive layer and capable of being separated into two sheet sections by hand.

In an embodiment of the recording composite sheet of the present invention, at least one of the two sheet sections is very thin.

In another embodiment of the recording composite sheet of the present invention, the two sheet sections can be recorded with colored images.

The above-mentioned object can be attained by the recording composite sheet of the present invention, which comprises (A) a first sheet section comprising
  (a) a first support sheet, and
  (b) a first recording layer formed on a surface of the first support sheet; and (B) a second sheet section comprising
  (c) a second support sheet,
  wherein the first and second sheet sections and are bonded to each other through a binder layer to such an extent that the bonded first and second sheet sections are separable from each other by hand.

In an embodiment of the recording composite sheet of the present invention, a second recording layer is formed on a surface of the second support sheet of the second sheet section, to which surface the first sheet section is not bonded.

In another embodiment of the recording composite sheet of the present invention, an additional recording layer is formed on the surface of the second support sheet of the second sheet section through which additional recording layer the second sheet section is bonded to the first sheet sections.

DESCRIPTION OF THE PREFERRED EMBODIMENTS

The preferred embodiments of the recording composite sheet of the present invention will be explained with reference to the attached drawings.

Figure 1:
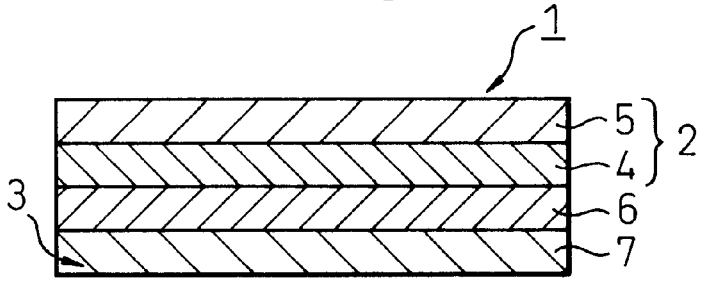
FIG. 1 is an explanatory cross-sectional view of an embodiment of the recording composite sheet of the present invention.
Figure 2:
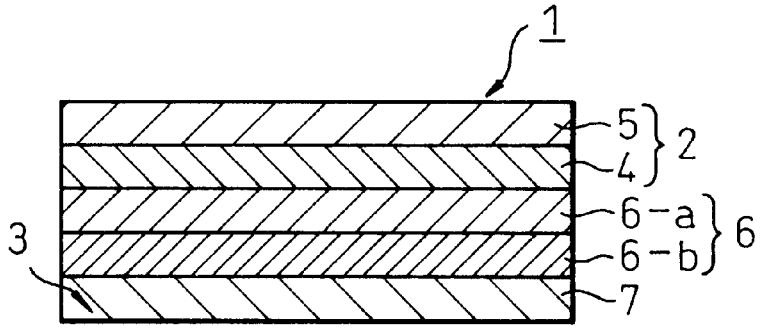
FIG. 2 is an explanatory cross-sectional view of another embodiment of the recording composite sheet of the present invention.
Figure 3:
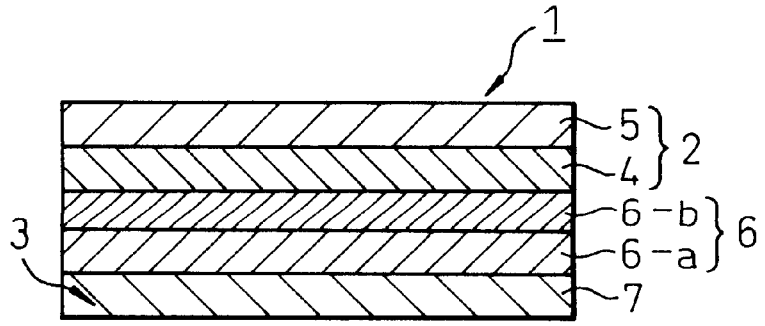
FIG. 3 is an explanatory cross-sectional view of still another embodiment of the recording composite sheet of the present invention.

In each of FIGS. 1 to 3, a recording composite sheet 1 comprises a first sheet section 2 and a second sheet section 3. The first sheet section 2 comprises a first support sheet 4 and a first recording layer 5 formed on a surface of the first support sheet 4. The second sheet section 3 comprises a second support sheet 7.

The first sheet section 2 and the second sheet sections 3 are superposed on each other and bonded to each other through a binder layer 6, to such an extent that the bonded first and second sheet sections 2 and 3 are separable from each other by hand. Preferably, the peeling strength between the first and second sheet sections 2 and 3 is preferably 200 g/25 mm or less, more preferably 6 to 130 g/25 mm, determined at a peeling angle of 180 degrees, in accordance with JIS Z 0237.

In FIG. 1, the lower surface of the first support sheet 4 of the first sheet layers is bonded to the upper surface of the second support sheet 7 of the second sheet section 3 through a single binder layer 6. In this case, the first support sheet 4 is separable from the binder layer 6 by hand and the second support sheet 7 is firmly bonded to the binder layer 6, or the second support sheet 7 is separable from the binder layer 6 by hand and the first support sheet 4 is firmly bonded to the binder layer 6.

In FIGS. 2 and 3, the binder layer 6 comprises a first binder layer 6*a* and a second binder layer 6*b*. In FIG. 2, a second binder layer 6*b* is formed on an upper surface of the second support layer by, for example, a melt-laminating method, and then, the lower surface of the first support sheet 4 of the first sheet section 2 is bonded to the upper surface of the second bonding layer 6*b* through a first binder layer 6*a*. In the recording composite sheet 1 of FIG. 2, the first support sheet 4 is separable from the first binder layer 6*a*, or the first binder layer 6*a* is separable from the second binder layer 6*b* or the second binder layer 6*b* is separable from the second support sheet 7, by hand peeling, preferably with a peeling force of 200 g/25 mm or less, more preferably 6 to 130 g/25 mm.

In FIG. 3, a second binder layer 6*b* is formed on a lower surface of the first support sheet 4 by, for example, a melt-laminating method, and an upper surface of the second support layer 7 is bonded to the second binder layer 7 through a first binder layer 6*a*. In this case, the first support sheet 4 is separable from the second binder layer 6*b*, or the second binder layer 6*b* is separable from the first binder layer 6*a*, or the first binder layer 6*a* is separable from the second support sheet 7, by a hand peeling, preferably with a peeling force of 200 g/25 mm or less, more preferably 6 to 130 g/25 mm.

When the first and second sheet sections 2 and 3 are peeled from each other, the resultant peeled surfaces of the first and second sheet sections 2 and 3 are free from pressure-sensitive adhesives, and thus the peeled surfaces do not self-adhere to other surfaces.

Figure 4:
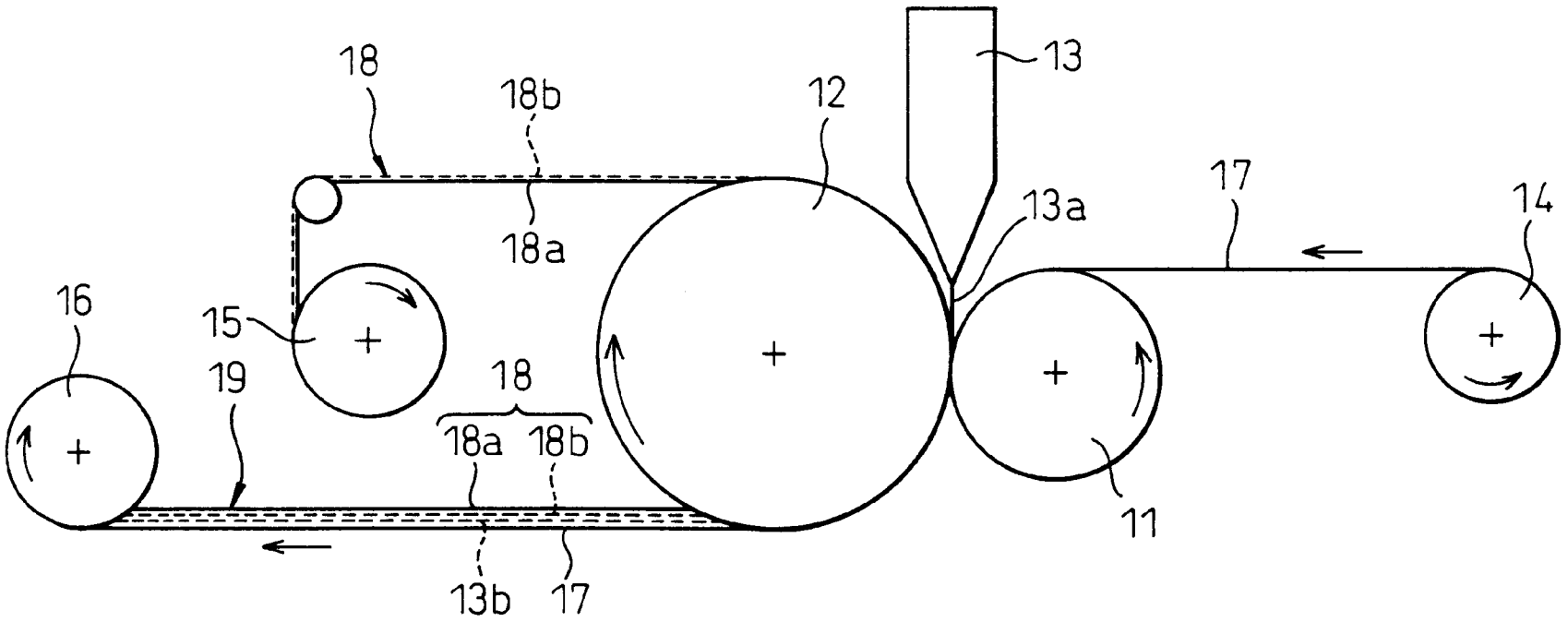
FIG. 4 is an explanatory front view of an apparatus for producing an embodiment of the recording composite sheet of the present invention.

Referring to FIG. 4 showing an apparatus for producing a recording composite sheet of FIG. 1 or 2, a first sheet 17 withdrawn from a first sheet roll 14 and a second sheet 18 withdrawn from a second sheet roll 15 are nipped under pressure between a pressing roll 11 and a cooling roll 12 rotating, respectively, in the directions of the arrows, while feeding a binder 13*a* from a T die 13 between the first and second sheets 17 and 18 so as to bond the first and second sheets 17 and 18 to each other through a layer of the binder, and a resultant laminate 19 is wound up into a roll 16. In FIG. 4, the second sheet 18 may consist of a second support sheet 18*a* and a second binder layer 18*b* formed by, for example, a melt-laminating method. In this case, the binder 13*a* fed from the T die 13 forms a first binder layer 13*b* between the first sheet 17 and the second binder layer 18*b*.

In the lamination procedure as shown in FIG. 4, the first binder layer 13*b* is formed from a thermoplastic resin, preferably a polyolefin resin, at a laminating temperature of 10 to 50° C. below a laminating temperature at which the binder is usually laminated to the first or second sheet. In the apparatus of FIG. 3, the second sheet 18 supplied from the roll 15 is cooled by the cooling roll 12 and then the melted binder 13*a* is laminated on the cooled second sheet 18, while the resultant laminate containing a binder layer 13*b* is cooled by the cooling roll 12, to thereby cause the bonding strength between the second sheet 12 and the binder layer 13*b* to be weak.

Therefore, the peeling strength between the second sheet 18 and the binder layer 13*b* can be controlled to a level of 200 g/25 mm or less, particularly 6 to 130 g/25 mm. In this case, the first and second sheet sections are separable on the interface between the second sheet section and the binder layer, while the binder layer is firmly bonded to the first sheet section.

In FIG. 4, the first sheet 17 may be replaced by a first support sheet and after the laminate is formed, a first recording layer may be formed on an outer surface of the first support sheet in the laminate.

In the recording composite sheet of the present invention, the first support sheet is formed from at least one member selected from, for example, paper sheets including wood free paper sheets, coated paper sheets, art paper sheets and castcoat paper sheets; polymer films including films of polyester (for example, polyethylene terephthalate (PET)) resins, nylon resins, polyolefin (for example, polypropylene) resins, polyvinyl chloride resins and cellulosic polymers; and synthetic paper sheets. The first support sheet may have a single layered structure or a two more-layered structure.

When the recording composite sheet is used for the thermal transfer recording system, and the first support sheet has a three-layered structure, for example, a polymer film or synthetic paper sheet layer/paper sheet core/polymer film or synthetic paper sheet layer structure, or a polymer film or synthetic paper sheet layer/PET film core/polymer film or synthetic paper sheet layer structure, a first thermal transfer image-recording layer formed on the multi-layered first support sheet can receive clear images therein.

The polymer films or synthetic paper sheets usable for the first support sheet of the present invention is preferably selected from those having at least one porous foam layer, or at least one void layer formed by, for example, a drawing procedure, or a non-porous skin layer and at least one inner void layer. When a paper sheet is used for the first support sheet, the paper sheet is not limited to specific type of paper sheet, as long as the paper sheet comprises, as a principal component, a cellulose pulp, and usually comprises at least one member selected from wood pulps, for example, soft and hard wood chemical and mechanical pulps, and used paper pulps. The paper sheets optionally comprises at least one member selected from non-wood pulps, for example, hemp pulp and cotton pulp, and synthetic pulps, for example, polyethylene pulps and polypropylene pulps. However, to keep a paper-formability of the pulp material at a practically permissible level, the pulp material preferably contains the wood pulp in a content of 50% by weight or more. When the wood pulp is contained in the above-mentioned content, the resultant paper sheet has a satisfactory appearance and hand and a sufficient mechanical strength for use in practice. Usually, the first support sheet preferably has a thickness of 30 to 300 $\mu$m, more preferably 50 to 250 $\mu$m.

In the first sheet section, the first recording layer formed on a surface of the first support sheet can receive at least one member selected from thermally transferred sublimating dyes, thermally transferred ink melts and ink jets and serve as a thermal transfer sublimating dye-receiving layer, a thermal transfer ink melt-receiving layer or an ink jet-receiving layer.

The thermal transfer sublimating dye-receiving layer contains, as a principal component, a dyeable polymer having a high dyeability with the sublimating dyes supplied from an ink ribbon. The dyeable polymer for the sublimating dye-receiving layer is preferably selected from polyester resins, polycarbonate resins, vinyl chloride copolymer resins, and cellulose derivatives. In the thermal transfer printing procedure using a thermal head, a fuse-adhesion of the dye-receiving layer with the ink ribbon is prevented by adding preferably at least one member selected from cross-linking agents, lubricating agents and release agents to the dye-receiving layer. Optionally, at Least one member selected from fluorescent brightness, plasticizers, anti-oxidants, pigments and ultraviolet ray-absorbers, is added to the dye-receiving layer. The above-mentioned additives may be mixed with the dye-receiving material and coated on the support sheet or may be coated as an uppercoat or undercoat for the dye-receiving layer.

The thermal transfer ink melt-receiving layer is formed from a mixture of a pigment with a water-soluble or water-dispersible polymeric material. The pigment comprises at least one member selected from inorganic pigments, for example, kaolin, calcined kaoline, calcium carbonate, calcium sulfate, barium sulfate, titanium dioxide, talc, zinc oxide, alumina, magnesium oxide, magnesium carbonate, and silica; and organic pigments, for example, polystyrene resins, urea-formaldehyde resins, melamine-formaldehyde resins and acrylic resins.

The polymeric material comprises at least one member selected from natural and semi-synthetic polymeric compounds, for example, starch compounds, for example, cationic starches, and oxidized starches, cellulose compounds, for example, carboxymethyl cellulose and hydroxyethyl cellulose, casein, soybean protein and natural rubber; synthetic polymers, for example, polyvinyl alcohol, polyisoprene, polydienes, for example, polybutadiene, polyalkenes, for example, polybutene, polyisobutylene, polypropylene and polyethylene, polymers and copolymers of vinyl compounds, for example, vinyl acetate, styrene, (meth)acrylic acid, (meth)acrylate esters, (meth)acrylamide and methylvinyl ether, latices of synthetic rubbers, for example, styrene-butadiene copolymers, and methylmethacrylate-butadiene copolymers, and polyurethane resins, polyester resins, polyamide resins, olefin-maleic anhydride copolymer resins and melamine-formaldehyde resins.

The ink Jet-receiving layer is formed from a mixture of a pigment with a binder.

The pigment comprises at least one member selected from inorganic pigments, for example, aluminum hydroxide, alumina, amorphous silica, magnesium oxide, colloidal silica, colloidal alumina, calcium carbonate, kaolin, talc, calcium sulfate, barium sulfate, titanium dioxide, zinc oxide, zinc carbonate, satin white, aluminum silicate, calcium silicate, magnesium silicate, and white carbon; and inorganic pigment, for example, styrene resins, acrylic resins, urea-formaldehyde resins, melamine-formaldehyde resins, and benzoguanamine resins.

The binder comprises an aqueous solution or dispersion of at least one member selected from natural and semi-synthetic polymeric compounds, for example, starch and derivatives thereof, carboxymethyl cellulose, hydroxyethyl cellulose and casein; and synthetic polymeric compounds, for example, polyvinylalcohol and derivatives thereof, polyvinylbutyral resins, polyethyleneimine resins, polyvinylpyrrolidone resins, poly(meth)acrylic acid resins, polyacrylate ester resins, polyamide resins, polyacrylamide resins, polyester resins, urea-formaldehyde resins, melamine-formaldehyde resins, styrene-butadiene copolymer resins, methyl methacrylate-butadiene copolymer resins, and ethylenevinyl acrylate copolymer resins; and anionic or cationic group-modified products of the above-mentioned polymers.

The first recording layer can be formed by coating a coating liquid for the dye, ink melt and/or ink jet-receiving layer on a surface of the first support sheet by a conventional coater, for example, bar coater, gravure coater, comma coater, blade coater or air knife coater, and drying the coating liquid layer. The first recording layer for the recording composite sheet of the present invention preferably has a dry weight of 1 to 20 g/m$^2$, more preferably 5 to 10 g/m$^2$.

To enhance the bonding strength between the first support sheet and the first recording sheet, an intermediate layer may be formed therebetween. The intermediate layer can be formed from conventional hydrophilic and hydrophobic adhesive resins. For example, the adhesive resins are selected from, for example, vinyl polymers such as polyvinyl alcohol and polyvinylpyrrolidone, acrylic polymers such as polyacrylamide, polydimethylacrylamide, polyacrylic acid and salts thereof, polyacrylate esters, methacrylic polymers such as polymethacrylic acid and polymethacrylate esters, and natural polymers such as starch, sodium alginate, casein carboxymethyl cellulose and derivatives thereof.

The second support sheet for the second sheet section is formed from, for example, paper sheets, for example, wood-free paper sheets, coated paper sheets, art paper sheets and castcoat paper sheets, laminated paper sheets, for example, paper sheets laminated with a thermoplastic resin such as polyethylene, thermoplastic resin films, for example, polyester (for example, polyethylene terephthalate), nylon and polyolefin (for example, polypropylene) films, and synthetic paper sheets. The second support sheet has a single layer structure or a two or more-layered structure.

When the second support sheet is made from a paper sheet, the paper sheet may suffer a ply separation when the second sheet section is peeled from the first sheet section. Accordingly, the second support sheet is preferably formed from a thermoplastic film, synthetic fiber or thermoplastic resin-laminated paper sheet. Particularly, polyethylene terephthalate (PET) films and bi-axially oriented polypropylene (OPP) films have a high durability and thus are suitable for the second support sheet.

Preferably, an antistatic layer containing an antistatic agent is formed on a surface of the second support sheet to which surface the first sheet section is not bonded.

The second support sheet may be the same as or different from, in sheet-forming material, the first support sheet. The second support sheet of the second sheet section preferably has a thickness of 0 to 300 $\mu$m, more preferably 50 to 250 $\mu$m.

The binder layer through which the first and second sheet sections are bonded to each other to such an extent that the bonded first and second sheet sections are capable of being peeled off from each other by hand. As mentioned above, the peeling strength between the first and second sheet sections is preferably 200 g/25 mm or less, more preferably 6 to 130 g/25 mm.

The binder layer is preferably formed from a thermoplastic resin by a heat-pressing method.

The thermoplastic resin is not limited to a specific type of resin, as long as the resin can form a hand-separable bonding between the first and second sheet layers. Preferably, the thermoplastic resin for the binder layer comprises at least one member selected from olefin polymers and copolymers, for example, polyethylene and polypropylene, polystyrene, and vinyl acetate copolymers, for example, ethylenevinyl acetate copolymers. There is no specific limitation to the thickness of the binder layer. Usually, the binder layer has a thickness of 5 to 60 $\mu$m, more preferably 10 to 50 $\mu$m. Also, as mentioned above, the binder layer on which the first or second sheet section is separable from the other sheet section is formed at a temperature of 10 to 50° C. below the usual lamination temperature. For example, when the binder layer is formed from a polyethylene resin, the resin is extruded through a T die at a temperature of 250° C. to 320° C. and laminated between the first sheet section and the second sheet section. When the first sheet section should be separable from the binder layer by hands, the first sheet section is brought into contact with a cooling roll and the second sheet section is brought into contact with a pressing roll, so that the first sheet section is bonded to the binder layer at a temperature lower than that of the second sheet section and thus the bonding strength between the first sheet section and the binder layer is lower than that between the second sheet section and the binder layer.

The bonding strengths of the binder layer to the first and second sheet sections are variable depending on the type of the first and second sheet sections. For example, when the first sheet section is formed from a paper sheet, the binder layer is formed from a thermoplastic resin, for example, a polypropylene resin, and the second sheet section is formed from the same resin as in the binder layer or a resin analogous in chemical structure and composition to and compatible with the binder layer-forming resin, for example, a polyethylene resin, the bonding strength between the first sheet section (paper sheet) and the binder layer is significantly lower than the bonding strength between the second sheet section (thermoplastic resin film) and the binder layer and thus the first sheet section is separable in the interface between the first sheet section and the binder layer. Also, when the first sheet section is formed from a paper sheet having a low smoothness, for example, a wood free paper sheet, kraft paper sheet or another paper sheet having a high surface roughness, and the second sheet section is formed from a paper sheet having a high smoothness, for example, a glassive paper sheet, the high smoothness second sheet section is separable, at the interface thereof with the binder layer, from the second sheet section.

To enable the first and second sheet sections formed from the same type of sheet material as each other to be stably separable, it is preferable that one of the first support sheet 4 and the second support sheet 7 be previously firmly laminated with a binder layer 6 comprising, for example, a thermoplastic resin, and other one of the first and second support sheets is bonded to binder layer by the heat-pressing method. The previous lamination for the binder layer is carried out preferably at a temperature higher than the heat-pressing temperature. For example, when the binder resin for the binder layer 6 is a polyethylene resin, the previous lamination is carried out at a temperature of 330° C. to 360° C. and the heat pressing procedure is carried out at a temperature of 250 to 320° C. Further, more preferably, a corona discharge treatment is applied to the surface of the support sheet to be laminated immediately before the lamination. In this case, when the first support sheet is laminated with the binder layer and then the second support sheet is bonded to the binder layer by the heat-pressing procedure at a temperature lower than the lamination temperature, the second support sheet is separable from the binder layer laminated on the first support sheet. Also, when the second support sheet is laminated with the binder layer and then the first support sheet is bonded to the binder layer by the heat-pressing procedure at a temperature lower than the lamination temperature, the first support sheet is separable from the binder layer laminated on the second support sheet.

When the one of the first and second support sheets 4 and 7 is previously laminated with a second binder layer **6*b* comprising a thermoplastic resin, and the other one of the support sheets is bonded to the second binder layer 6*b* through a first binder layer 6*a* comprising the same thermoplastic resin as in the second binder layer 6*b*, by the heat pressing procedure at a temperature lower than the lamination temperature, the other support sheet is separable from the first binder 6*a*, because the bonding strength between the first binder layer 6*a* and the second binder 6*b* is higher than the bonding strength between the other support sheet and the first binder layer. However, if the first binder layer 6*a* is formed from a thermoplastic resin having a poor compatibility with the second binder layer 6*b***, the first and second sheet sections are separable from each other in the interface between the first and second binder layers. In this case, for example, one of the first and second binder layers is formed from a polyethylene resin, and the other one is formed from a polyester resin.

Further, the first and second sheet sections can be made separable from each other by applying a release agent, for example, a silicone to an interface in which the sheet sections have to be separated from each other.

In the recording composite sheet of the present invention, the interface in which the first and second sheet sections can be separated from each other can be formed in the above-mentioned manners.

As mentioned above, since the first and second sheet sections are bonded with a certain bonding strength to each other through the binder layer, they are not separated during usual recording procedure unless a peeling force higher than the bonding strength is applied to the composite sheet. When a peeling force higher than the bonding strength is applied, the first and second sheet sections can be easily separated from each other without being broken. Also, since the peeled surfaces exhibit no pressure-sensitive adhesive property, the first and second sheet sections do not adhere to each other even when they are superposed on each other. Also, the peeled surfaces are smooth and exhibit a satisfactory appearance.

In the recording composite sheet of the present invention, there is no limitation to the thickness of each of the first and second sheet sections, and to the total thickness of the sheet sections. Usually, the total thickness is preferably 100 to 300 $\mu$m, more preferably 150 to 250 $\mu$m.

Figure 5:
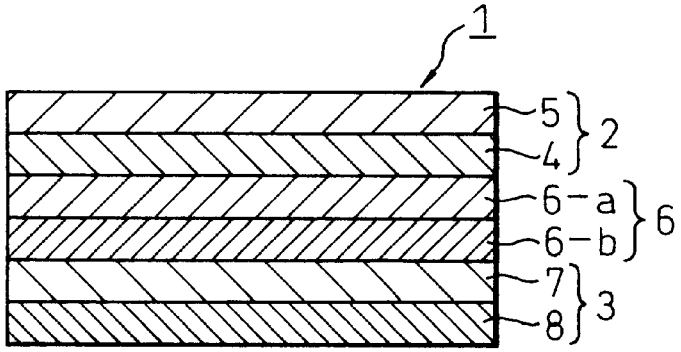
FIG. 5 is an explanatory cross-sectional view of still another embodiment of the recording composite sheet of the present invention.

In the recording composite sheet of the present invention, a second recording layer is optionally formed on a surface of the second support sheet to which surface the first sheet section is not bonded. In FIG. 5, a second recording layer 8 is formed on a surface of a second support sheet 7, which surface is opposite to the surface on which the first sheet section 2 is bonded through a binder layer 6 consisting of a first binder layer **6*a* and a second binder layer 6*b*, to form together a second sheet section 3**.

The second recording layer can be formed from the materials usable for the first recording layer.

The thickness, constitution and recording function of the second recording layer may be the same as or different from those of the first recording layer.

The second recording layer can receive at least one of thermally transferred sublimating dyes, thermally transferred ink melts and ink jets. In other words, the second recording layer is a thermal transfer sublimating dye-receiving layer, a thermal transfer ink melt-receiving layer or an ink jet-receiving layer.

The recording composite sheet having the constitution shown in FIG. 5 is not limited to a specific use. For example, when the first sheet section has a small thickness of 100 $\mu$m or less, desired images are recorded on the first recording layer, then the thin first sheet section is peeled off from the second sheet section and subjected to a desired use. Then desired images are printed on the second recording layer, and the resultant printed second sheet section is subjected to a desired use.

When the thicknesses of both the first and second sheet sections are smaller than 100 $\mu$m, desired images are printed on the first and second recording layers of the composite sheet, then the printed first sheet section is separated from the printed second sheet section, and each of the sheet sections are subjected to a desired use.

In the recording composite sheet of the present invention, optionally an additional recording layer is formed between the first and second sheet sections.

Figure 6:
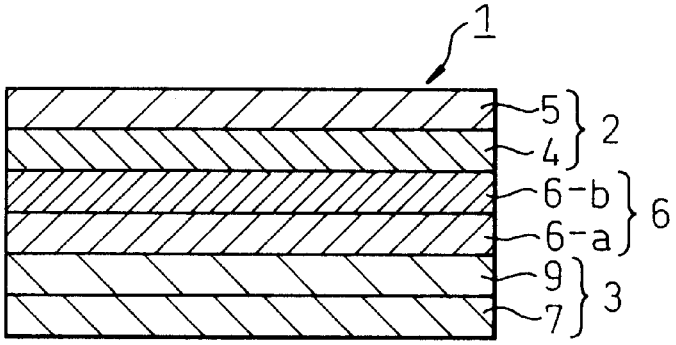
FIG. 6 is an explanatory cross-sectional view of still another embodiment of the recording composite sheet of the present invention.

In FIG. 6, an additional recording layer 9 is formed on a surface of a second support sheet 7 to form together a second sheet section 3. The additional recording layer 9 of the second sheet section 3 is bonded to a first support sheet 4 of a first sheet section 2 through a binder layer 6 consisting of a second binder layer 6*b* melt-laminated to the first support sheet 4 and a first binder layer 6*a* bonded to the additional recording layer 9 with a low bonding strength and to the second binder layer 6*b* with a bonding strength higher than the above-mentioned low bonding strength. In this case, the second sheet section 3 is separable at the interface between the additional recording layer 9 and the first binder layer 6*a*, from the first sheet section 2. Accordingly, when the second sheet section 3 is separated, the additional recording layer 9 is exposed to the outside, and can be directly printed without turning the separated second sheet section over.

The additional recording layer can be formed from the materials usable for the first recording layer.

The thickness, constitution and recording function of the additional recording layer may be the same as or different from those of the first recording layer.

The additional recording layer can receive at least one of thermally transferred sublimating dyes, thermally transferred ink melts and ink jets. In other words, the additional recording layer is a thermal transfer sublimating dye-receiving layer, a thermal transfer ink melt-receiving layer or an ink jet-receiving layer.

In the recording composite sheet of the present invention, optionally a back coating layer comprising an antistatic agent is formed on a surface of the second sheet section to which surface the first sheet section is not bonded.

Figure 7:
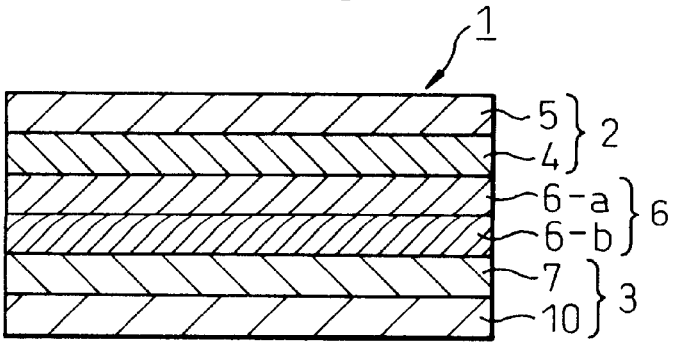
FIG. 7 is an explanatory cross-sectional view of still another embodiment of the recording composite sheet of the present invention.

Referring to FIG. 7, an antistatic layer 10 is formed on the back surface of a second support sheet 7 to form together a second sheet section 3. When the antistatic layer is formed on the back surface, the resultant composite sheet can be smoothly fed into, passed through, and delivered from the printer.

The antistatic agent for the antistatic layer preferably comprises at least one member selected from, for example, polyethyleneimine, cationic monomer-modified acrylic polymers and copolymers, cation-modified acrylamide polymers and copolymers, and cationic starches. The antistatic agent is usually mixed with a binder to form the antistatic layer. The binder preferably comprises at least one member selected from, for example, water-soluble polymers, for example, polyvinyl alcohol, and acrylic resins, epoxy resins, polyester resins, phenol-formaldehyde resins, alkyd resins, polyurethane resins, melamine-formaldehyde resins, and cured products of the above-mentioned resins.

The antistatic layer is preferably formed in a dry weight of 0.3 to 10 g/m$^2$, more preferably 0.5 to 3 g/m$^2$.

In the recording composite sheet of the present invention, the back surface of the first sheet section to which surface the second sheet section is bonded, the front surface of the second sheet section to which surface the first sheet section is bonded, the back surface of the second sheet section and/or the back surface of the antistatic layer is optionally previously printed with desired images. Particularly, the bonded surfaces, for example, the back surface of the first sheet section and the front surface of the second sheet section cannot be observed from the outside of the composite sheet before separation. Therefore, secret information, for example, raffle images or pictures, can be recorded on the inside surfaces. The recorded images or pictures on the inside surface can be observed when the first and second sheet sections are separated from each other. In the recording composite sheet, at least a portion of periphery edges of the bonded surfaces of the first and second sheet sections is optionally not bonded. The not-bonded portion can be utilized as a starting point of the separation. The separation-starting portion can be formed by slightly extending an edge portion of one of the sheet sections over the other sheet section, or by cut-removing a small edge portion of one of the sheet sections. In the former, the bonding areas or forms of the first and second sheet sections are made slightly different from each other. When the first and second sheet sections are the same in area and form as each other, the first and second sheet sections are bonded in slightly irregular positions to each other.

By providing the not-bonded portion, the first and second sheet sections can be easily separated from each other without breaking the separation-starting portions.

The recording composite sheet can be employed in the following uses.

(1) A use in which a thin recording sheet having a thickness of 100 $\mu$m or less, particularly 60 $\mu$m or less is printed by a conventional recording system, for example, a thermal transfer dye printer, thermal transfer ink printer or ink jet printer.

For this use, a recording composite sheet having a first sheet section formed from a thin sheet is provided, desired images are formed on the first recording layer of the first sheet section, and then the image-recorded first sheet section is separated from the composite sheet and subjected to a desired use.

(2) A use in which the first and second sheet sections each having a recording layer are separated from each other and used for separate uses.

In this case, the recording composite sheet, a first recording layer located on the front surface of the first sheet section and a second recording layer located on the back surface of the second sheet section are separately printed, and the printed first and second sheet sections are separated from each other and subjected to separate uses.

(3) A use in which a printed first sheet section is separated from a non-printed second sheet section having an additional recording layer, the additional recording layer is printed and subjected to desired use.

In this case, the additional recording layer of the second sheet section is bonded to the first sheet section.

When the first sheet section is separated from the second sheet section, the exposed additional recording layer can be directly printed without turning the second sheet section over.

In the recording composite sheet of FIG. 6, when a third sheet section consisting of an additional recording layer formed on a third support sheet is attached to the back surface of the second support sheet 7 of the second sheet section 3, through a binder layer to such an extent the attached third sheet section is separable from the second sheet section, the third recording layer can be printed after separation.

In the same manner as mentioned above, the recording composite sheet can contain four or more thin sheet sections each having a recording sheet and capable of being printed.

(4) A use in which concealed information is recorded on at least one inside surface of sheet sections bonded to each other, in non-visible condition. When the sheet sections are separated from each other, the recorded information can be observed.

In this case, at least one surface of the first and second sheet sections are printed and the printed surface of the sheet sections is bonded to the other sheet section. This type of recording composite sheet is useful for raffle- and post-cards.

(5) A use in which a recording composite sheet is required to have a sheet section having a high stretchability and to exhibit a satisfactory passing property through a printer.

In this case, high stretching sheet section is bonded to another sheet section having substantially no stretchability. Accordingly, the resultant recording composite sheet exhibits, as a whole, a substantially no stretchability and thus can pass smoothly through the printer, with no trouble due to the stretch of the stretchable sheet section. After printing, the stretchable sheet section is separated from the other sheet section and subjected to a desired use.

EXAMPLES

The present invention will be further explained by the following examples which are merely representative and do not restrict the scope of the present invention in any way.

In the examples, "%" and "part" are based on weight unless specifically indicated.

Example 1

A recording composite sheet was produced by the following procedures.

(1) Preparation of a laminated sheet for a first sheet section (A) Preparation of a first support sheet The front and back surfaces of a coated paper sheet having a thickness of 60 $\mu$m. (trademark: OK COAT 64, made by OJI PAPER CO. LTD.) Where coated each with a biaxially oriented polyolefin film having a thickness of 50 $\mu$m (trademark: HGU 50, made by OJI YUKAGOSEISHI K.K.) through a polyester resin binder by a dry laminate method, to provide a first support sheet.

(B) Formation of a thermal transfer dye-receiving layer (first recording layer).

A front surface of the laminated sheet as mentioned above was coated with a coating liquid having a composition as shown below by a bar coating method and dried to form an anchor coat layer having a dry weight of 1 g/m$^2$. Then a coating liquid having a composition as shown below was coated on the anchor coat layer and dried to form a first recording layer having a dry weight of 6 g/m$^2$.

Composition of Anchor Coat-forming Liquid

| Component | Part |
|---|---|
| Polyethyleneimine (trademark: PSP061, made by NIHON SHOKUBAIKAGAKU K.K.) | 4 |
| Ethyl alcohol | 100 |

Composition of First Recording Layer-forming Liquid

| Component | Part |
|---|---|
| Polyester resin (trademark: VYLON 200, made by TOYOBOSEKI K.K.) | 100 |
| Silicone oil (trademark: KF 393, made by SHINETSU SILICONE K.K.) | 3 |
| Isocyanate (trademark: TAKENAT D-110N, made by TAKEDA YAKUHIN K.K.) | 5 |
| Toluene | 300 |

The resultant laminated sheet for the first sheet section had a thickness of 130 $\mu$m.

(2) Preparation of a laminated sheet for second sheet section.

A back surface of a PET film having a thickness of 38 $\mu$m was coated with a coating liquid having a composition as shown below and dried to provide a back coating layer having a dry weight of 1.0 g/m$^2$.

Composition of Back Coating Layer-forming Liquid

| Component | Part |
|---|---|
| Acrylic resin (trademark: SA-R615A, made by CHUO RIKA K.K.) | 100 |
| Silica pigment (trademark: PM 363, made by MIZUSAWA KAGAKU K.K.) | 20 |
| Isopropyl alcohol | 300 |
| Toluene | 100 |

On the front surface of the PET film was laminated a polyethylene resin (trademark: L719, made by UBE INDUSTRIES, Ltd.) at a temperature of 330° C. by an extrusion lamination method to form a second binder layer.

The resultant laminated sheet for a second sheet section had a thickness of 50 $\mu$m.

(3) Production of a recording composite sheet.

By using the apparatus shown in FIG. 4, the laminated sheet for the first sheet section and the laminated sheet for the second sheet section were introduced into the heat-pressing roll system in such a manner that the polyethylene resin layer surface of the second sheet section faces the back surface of the first support sheet of the first sheet section and the second sheet section is brought into contact with the cooling roll and the first sheet section is brought into contact with the pressing roll, and a polyethylene resin melted at a temperature of 300° C. was applied in an amount of 20 $\mu$/m$^2$ to the back surface of the first support sheet and the second sheet section is press-bonded to the first sheet section through the polyethylene resin layer (a first binder layer). A recording composite sheet having a similar constitution to in FIG. 7 was obtained.

In the resultant recording composite sheet, the first sheet section and the second sheet section could be separated in the interface between the PET film layer of the second sheet section and the second binder layer retained on the first binder layer bonded to the first sheet section.

Example 2

A recording composite sheet was produced by the same procedures as in Example 1, with the following exceptions.

A laminated sheet for a first sheet section was prepared by laminating the front and back surfaces of a PET film having a thickness of 75 μm (trademark: W900J75, made by DIAFOIL HOECHST K.K.) each with a biaxially oriented polyolefin film having a thickness of 60 μm (trademark: FPG60, made by OJI YUKAGOSEISHI K.K.) through a polyester resin binder by a dry laminate method.

On the front surface of the laminated sheet, an anchor coat layer and a first recording layer were formed by the same procedures as in Example 1, to provide a laminate sheet for a first sheet section.

The back surface of the PET film layer of the first sheet section was bonded to the second binder layer laminated to the second sheet section by the press-bonding procedure through a first binder layer consisting of a polyethylene resin melted at a temperature of 300° C. The bonded second and first sheet sections were separable from each other at the interface between the PET film layer of the second sheet section and the second binder layer.

Example 3

A recording composite sheet was produced by the same procedures as in Example 1, with the following exceptions.

A laminated sheet for a first sheet section was prepared by coating the front surface of a first support sheet consisting of a biaxially oriented polyolefin film having a thickness of 150 μm (trademark: FPG 150, made by OJI YUKAGOSEISHI K.K.) with the same anchor coat layer and first recording layer as those in Example 1. The resultant laminated sheet for the first sheet section had a thickness of 155 μm.

The back surface of the first support sheet of the first sheet section was bonded to the second binder (polyethylene resin) layer laminated to the second sheet section through a first binder layer consisting of a polyethylene resin melted at a temperature of 290° C. and in an amount of 20 g/m$^2$, by the pressing-bonding method.

In the resultant recording composite sheet, the first and second sheet sections were separable from each other at an interface between the PET film layer and the second binder layer.

Example 4

A recording composite sheet was produced by the same procedures as in Example 1, with the following exceptions.

When the second binder (polyethylene resin) layer laminated to the second sheet section was bonded to the back surface of the first sheet section by the press-bonding procedure, the first binder layer was formed from a melt of a mixed resin of a polyethylene resin with a polypropylene resin (trademark: FL 25R, made by MITSUBISHI CHEMICAL CO.) at a temperature of 300° C. The first binder layer was in an amount of 20 g/m$^2$.

In the resultant recording composite sheet, the first and second sheet sections were separable from each other at an interface between the PET film layer and the second binder layer.

Example 5

A recording composite sheet was produced by the same procedures as in Example 1, with the following exceptions.

When the second binder (polyethylene resin) layer laminated to the second sheet section was bonded to the back surface of the first sheet section by the press-bonding procedure, the first binder layer was formed from a melt of a polypropylene resin (trademark: FL 25R, made by MITSUBISHI CHEMICAL CO.) at a temperature of 300° C. The first binder layer was in an amount of 20 g/m$^2$.

In the resultant recording composite sheet, the first and second sheet sections were separable from each other at an interface between the PET film layer and the second binder layer.

Example 6

A recording composite sheet was produced by the same procedures as in Example 1, with the following exceptions.

In the second sheet section, the PET film with a thickness of 38 μm was replaced by a coated paper sheet having a thickness of 60 μm (trademark: OK COAT 64, made by OJI PAPER CO.).

In the resultant recording composite sheet, the first and second sheet sections were separable at an interface between the back surface of the first sheet section and the first binder layer.

Example 7

A recording composite sheet was produced by the same procedures as in Example 1, with the following exceptions.

In the preparation of the laminated sheet for the second sheet section, no second binder (polyethylene resin) layer was laminated.

The back surface of the laminated sheet for the first sheet section was laminated with a polyethylene resin (trademark: L719, made by UBE INDUSTRIES, Ltd.) by an extrude-lamination method at a temperature of 330° C. to form a first binder layer having a thickness of 20 μm.

In the press bonding of the first sheet section to the second sheet section, the non-coated front surface of the second sheet section faced the first binder (polyethylene resin) layer surface of the first sheet section, was coated with a melt of a polyethylene resin at a temperature of 300° C. and was then press-bonded to the first binder layer of the first sheet section without melting the first binder layer.

In the resultant recording composite sheet, the first and second sheet sections were separable from each other at an interface between the PET film layer and the second binder layer.

TESTS

A sample of the recording composite sheet prepared in each of Examples 1 to 7 was printed with step pattern images controlled by a color bar signal-dispatching device (trademark: C13A2, made by Shibazoku K.K.), by using a dye thermal transfer printer.

The bond retention and peeling strength between the first and second sheet sections were tested by the following testing methods.

(1) Bond-retaining property

After the printing procedure, the bond retention between the first and second sheet sections was evaluated by a naked eye observation in accordance with the following classification.

| Class | Bond retention |
|---|---|
| 3 | No separation |
| 2 | Little separation was found, and practically stable |
| 1 | Complete separation |

(2) Peeling strength

A 180 degree peeling test was carried out for a specimen having a width of 25 mm by using a tensile tester (TENSILON®, made by ORIENTEC) at a peeling speed of 300 m/min. at a peeling angle of 180 degrees.

The test results are shown in Table 1.

TABLE 1

| | Item | | |
|---|---|---|---|
| | Bond | Peeling strength (g/25 mm) | |
| Example No. | retention during printing | Longitudinal direction | Transverse direction |
| 1 | 3 | 25 | 8 |
| 2 | 3 | 100 | 10 |
| 3 | 2 | 125 | 15 |
| 4 | 3 | 40 | 10 |
| 5 | 2 | 30 | 8 |
| 6 | 3 | 30 | 6 |
| 7 | 3 | 25 | 8 |

Table 1 clearly shows that in each of the recording composite sheets of Examples 1 to 7, the first and second sheet sections were not separated during the printing procedure, and could be easily separated after the printing procedure.

Example 8

A recording composite sheet was produced by the following procedures.

(1) Preparation of a laminated sheet for a first sheet section (A) Preparation of a first support sheet The front and back surfaces of a coated paper sheet having a thickness of 60 μm (trademark: OK COAT 64, made by OJI PAPER CO. LTD.) were coated each with a biaxially oriented polyolefin film having a thickness of 50 μm (trademark: HGU 50, made by OJI YUKAGOSEISHI K.K.) through a polyester resin binder by a dry laminate method, to provide a first support sheet.

(B) Formation of a thermal transfer dye-receiving layer (first recording layer)

A front surface of the laminated sheet as mentioned above was coated with a coating liquid having a composition as shown below by a bar coating method and dried to form an anchor coat layer having a dry weight of 1 g/m$^2$. Then a coating liquid having a composition as shown below was coated on the anchor coat layer and dried to form a first recording layer having a dry weight of 6 g/m$^2$.

Composition of Anchor Coat-forming Liquid

| Component | Part |
|---|---|
| Polyethyleneimine (trademark: PSP061, made by NIHON SHOKUBAIKAGAKU K.K.) | 4 |
| Ethyl alcohol | 100 |

Composition of First Recording Layer-forming Liquid

| Component | Part |
|---|---|
| Polyester resin (trademark: VYLON 200, made by TOYOBOSEKI K.K.) | 100 |
| Silicone oil (trademark: KF 393, made by SHINETSU SILICONE K.K.) | 3 |
| Isocyanate (trademark: TAKENAT D-110N, made by TAKEDA YAKUHIN K.K.) | 5 |
| Toluene | 300 |

The resultant laminated sheet for the first sheet section had a thickness of 130 μm.

(2) Preparation of a laminated sheet for second sheet section

A laminated sheet having a second thermal transfer dye-receiving layer (recording layer) formed on a back surface of a second support sheet was prepared by the same procedures as in the preparation of the laminated sheet for the first sheet section.

On the front surface of the second support sheet of the laminated sheet, a second binder layer was coated with a polyethylene resin (trademark: L719, made by UBE INDUSTRIES, LTD.) by an extrude lamination procedure at a temperature of 330° C. A sheet for the second sheet section having a thickness of 145 μm was obtained.

(3) Production of a recording composite sheet

In the apparatus as shown in FIG. 4, the back surface of the first sheet section was faced the second binder (polyethylene resin) layer of the second sheet section, coated with a melt of a polyethylene resin at a temperature of 300° C. to form a first binder layer having a weight of 20 g/m$^2$, and press-bonded to the second binder (polyethylene resin) layer of the second sheet section between the cooling roll and the pressing roll.

A recording composite sheet having the constitution shown in FIG. 5 was obtained.

A printing procedure with step pattern images controlled by a color bar signal dispatching device (trademark: C13A2, SHIBAZOKU K.K.) was applied by using a dye thermal transfer printer (trademark: AGEP 60, made by MATSUSHITA DENKI K.K.) to the first and second recording layers. Clear colored images were recorded on the first and second layers. Also, after the printing procedure, the printed first and second sheet sections were easily separated from each other at an interface between the back surface of the first sheet section and the first binder layer. The 180 degree peeling strength between the first and second sheet sections was 30 g/25 mm in the longitudinal direction.

Example 9

A recording composite sheet was produced by the following procedures.

(1) Preparation of a laminated sheet for a first sheet section

A laminated sheet having a first recording layer formed on a front surface of a first support sheet through an anchor coat layer was prepared by the same procedures as in Example 8, and a back surface of the first support sheet was laminated with a first binder layer consisting of a polyethylene resin (trademark: L719, made by UBE INDUSTRIES, LTD.) by an extrude-lamination procedure at a temperature of 330° C.

The resultant laminated sheet for the first sheet section had a thickness of 140 μm.

(2) Preparation of a laminated sheet for a second sheet section

A laminated sheet for a second sheet section was prepared by the same procedures as in the preparation of the first sheet section of Example 8.

(3) Production of a recording composite sheet

In the apparatus shown in Table 4, the second recording layer surface of the second sheet section faced the second binder (polyethylene resin) layer surface on the first sheet section, was coated with a polyethylene resin melt at a temperature of 300° C. to form a second binder layer in an amount of 20 g/m$^2$, and was press-bonded to the second binder layer on the first sheet section. The resultant recording composite sheet had the constitution shown in FIG. 6.

The first recording layer could be printed with step patterned images controlled by a color bar signal dispatching device (trademark: C13A2, made by SHIBAZOKU K.K.), by a dye thermal transfer printer (trademark: AGEP60, made by MATSUSHITA DENKI K.K.). The printed images were clear. After the printing procedure, the printed first sheet section could be easily separated from the second sheet section at an interface between the second binder layer and the second recording layer of the second sheet section.

The second recording layer of the separated second sheet section was printed with clear images by the dye thermal transfer printer.

The 180 degree peeling strength between the first and second sheet sections was 20 g/25 mm in the longitudinal direction.

Example 10

An ink jet recording composite sheet was produced by the following procedures.

(1) Preparation of a laminated sheet for a first sheet section

A front surface of first support sheet consisting of a wood free paper sheet having a basis weight of 83 g/m$^2$ was coated with a coating liquid having the composition shown below and dried to form a first ink jet-receiving (recording) layer in a dry weight of 11 g/m$^2$.

Composition of Coating Liquid

| Component | Part |
|---|---|
| Calcium carbonate (trademark: TAMA PEARL TP-121, made by OKUTAMA KOGYO K.K.) | 75 |
| Polyvinyl alcohol (trademark: PVA-117, made by KURARAY K.K.) | 10 |
| Starch (trademark: ACE A, made by OJI CORNSTARCH K.K.) | 10 |
| Cationic polydiallyldimethylammonium chloride resin (trademark: PAS-H-5L, made by NITTO BOSEKI K.K.) | 5 |

(2) Preparation of a laminated sheet for a second sheet section

The same laminated sheet as that for the first sheet section was prepared, with the following exception.

In the laminated sheet, a second ink jet-receiving (recording) layer was formed on the back surface of a second support sheet. Also, the front surface of the second support sheet was coated with a polyethylene resin (trademark: L719, made by UBE INDUSTRIES, LTD.) by an extrude-lamination procedure at a temperature of 330° C., to form a second binder (polyethylene resin) layer in an amount of 20 g/m$^2$.

The resultant laminated sheet for the second sheet section had a thickness of 105 μm.

(3) Production of an ink jet recording composite sheet

In the apparatus of FIG. 4, the back surface of the first sheet section was faced the second binder layer on the second sheet section, coated with a melt of a polyethylene resin at a temperature of 300° C. to form a first binder (polyethylene resin) layer in an amount of 20 g/m$^2$, and press-bonded to the second binder layer on the second sheet section. The resultant ink jet recording composite sheet had the constitution as shown in FIG. 5.

The first recording layer located on the front surface of the composite sheet and the second recording layer located on the back surface of the composite sheet could be printed with clear images by an ink jet printer (model: MACHJET MJ-800C, made by SEIKO-EPSON K.K.). After printing, the printed first and second sheet sections could be easily separated from each other at an interface between the back surface of the first sheet section and the first binder layer, and used separately.

The 180 degree peeling strength between the first and second sheet sections was 35 g/25 mm in the longitudinal direction.

Example 11

An ink jet recording composite sheet was produced by the following procedure.

(1) Preparation of a laminated sheet for a first sheet section

The same laminated sheet having a first ink jet recording layer formed on the front surface of the first support sheet as in Example 10 was further coated on the back surface thereof with a polyethylene resin (trademark: L718, made by UBE INDUSTRIES, LTD.) by an extrude-lamination procedure at a temperature of 330° C. to form a second binder (polyethylene resin) layer in an amount of 20 g/m$^2$.

The resultant laminated sheet for the first sheet section had a thickness of 105 μm.

(2) Preparation of a laminated sheet for a second sheet section

A laminated sheet in which a second ink jet recording layer was located on the front surface of a second support sheet, was prepared by the same procedures as in the preparation of the laminated sheet for the first sheet section of Example 10.

(3) Production of an ink jet recording composite sheet

In the apparatus of FIG. 4, the second binder (polyethylene resin) layer on the first sheet section faced the second ink jet recording layer of the second sheet section, was coated with a polyethylene resin melt at a temperature of 300° C. to form a first binder (polyethylene resin) layer in an amount of 20 g/m$^2$, and was press-bonded to the second ink jet recording layer through the first binder layer, by the cooling roll and the pressing roll. The resultant composite sheet had the constitution as shown in FIG. 6.

By using an ink jet printer (model: MACHJET MJ-800C, made by SEIKO-EPSON K.K.), the first recording layer was printed with clear ink jet images. After printing, the printed first sheet section was easily separated from the second sheet section at an interface between the second binder layer and the second recording layer. Then the second recording layer of the separated second sheet section was printed with clear ink jet images.

The 180 degree peeling strength between the first and second sheet sections was 20 g/25 mm in the longitudinal direction.

Example 12

An ink jet recording composite sheet was produced by the following procedures.

(1) Preparation of a laminated sheet for a first sheet section

A laminated sheet for a first sheet section having a first thermal transfer dye recording layer was prepared by the same procedures as in Example 8.

(2) Preparation of a laminated sheet for a second sheet section

A laminated sheet for a second sheet section having a second ink jet recording layer was prepared by the same procedures as in Example 10.

(3) Production of an ink jet recording composite sheet

In the apparatus of FIG. 4, the back surface of the first sheet section faced the second binder (polyethylene resin) layer on the second sheet section, was coated with a melt of a polyethylene resin at a temperature of 300° C. to form a first binder layer in an amount of 20 g/m$^2$, and was press-bonded to the second binder layer of the second sheet section through the first binder section, by the cooling roll and the pressing roll.

The resultant composite sheet had the constitution as shown in FIG. 5.

The first recording layer located on the front surface of the resultant composite sheet was printed with clear dye images in a step pattern controlled by a color bar signal dispatching device (trademark: C13A2, made by SHIBAZOKU K.K.), by using a dye thermal transfer printer (trademark: AGEP60, made by MATSUSHITA DENKI K.K.). Also, the second recording layer located on the back surface of the composite sheet was printed with clear ink jet images by using an ink jet printer (trademark: MACHJET MJ-800C, made by SEIKO-EPSON K.K.). The printed composite sheet was easily separated into printed first and second sheet sections at an interface between the second binder layer and the front surface of the second sheet section.

The recording composite sheet of the present invention enables a thin recording sheet which could not be printed by conventional printers to be smoothly printed. Also, since no pressure-sensitive adhesive was used, the separated sheet sections exhibit no pressure-sensitive adhering property and can be handled as usual recording sheets.

The 180 degree peeling strength between the first and second sheet sections was 30 g/25 mm in the longitudinal direction.

What is claimed is:

1. A recording composite sheet comprising:

(A) a first sheet section comprising
  (a) a first support sheet, and
  (b) a recording layer formed on a surface of the first support sheet; and (B) a second sheet section comprising
  (c) a second support sheet,
  wherein the first and second sheet sections are bonded to each other through a binder layer comprising an extrudable thermoplastic resin comprising at least one member selected from the group consisting of polyethylene, polypropylene, polystyrene and ethylene-vinyl acetate copolymers, to such an extent that the bonded first and second sheet sections exhibit a peeling strength of up to 200 g/25 mm, determined at a peeling angle of 180° and are separable from each other by hand, the separated sheets being free of pressure-sensitive adhesive properties.

2. The recording composite sheet as claimed in claim 1, wherein the binder layer is formed by melt-extruding at least one thermoplastic resin stream between the first and second sheets sections, and cool-pressing the resultant laminate between a cooling roll and a pressing roll.

3. The recording composite sheet as claimed in claim 2, wherein the thermoplastic resin is a polyolefin resin.

4. The recording composite sheet as claimed in claim 1, wherein the recording layer is capable of receiving at least one member selected from thermally transferred sublimating dyes, thermally transferred ink melts and ink jets.

5. The recording composite sheet as claimed in claim 1, further comprising a second recording layer formed on a surface of the second support sheet of the second sheet section, to which surface the first sheet section is not bonded.

6. The recording composite sheet as claimed in claim 5, wherein the second recording layer is capable of receiving at least one member selected from thermally transferred sublimating dyes, thermally transferred ink melts and ink jets.

7. The recording composite sheet as claimed in claim 1, further comprising a back coating layer comprising an antistatic agent and formed on a surface of the second sheet section, to which surface the first sheet section is not bonded.

8. The recording composite sheet as claimed in claim 1, wherein the peeling strength is 6 to 130 g/25 mm.

9. The recording composite sheet as claimed in claim 1, wherein the total thickness of the combined sheet sections is 100 to 300 $\mu$m.

10. The recording composite sheet as claimed in claim 1, wherein each sheet section has a thickness of 30 to 300 $\mu$m.

11. A recording composite sheet comprising:

(A) a first sheet section including
  (a) a first support sheet, and
  (b) a recording layer formed on a surface of the first support sheet; and (B) a second sheet section including
  (c) a second support sheet, and
  (d) an additional recording layer formed on a surface of the second support sheet of the second section, through which additional recording layer the second sheet section is bonded to the first sheet section,
  wherein the first and second sheet sections are bonded to each other through a binder layer to such an extent that the bonded first and second sheet sections are separable from each other by hand.

12. The recording composite sheet as claimed in claim 11, wherein the additional recording layer is capable of receiving at least one member selected from thermally transferred sublimating dyes, thermally transferred ink melts and ink jets.

13. The recording composite sheet as claimed in claim 11, wherein the total thickness of the combined sheet sections is 100 to 300 $\mu$m.

14. The recording composite sheet as claimed in claim 11, wherein each sheet section has a thickness of 30 to 300 $\mu$m.

15. A recording composite sheet comprising:

(A) a first sheet section including
  (a) a first support sheet, and
  (b) a recording layer formed on surface of the first support sheet; and (B) a second sheet section including (c) a second support sheet, and (d) an additional recording layer formed on a surface of the second support sheet of the second section, through which additional recording layer the second sheet section is bonded to the first sheet section, wherein the first and second sheet sections are bonded to each other through a binder layer comprising an extrudable thermoplastic resin comprising at least one member selected from the group consisting of polyethylene, polypropylene, polystyrene and ethylene-vinyl acetate copolymer to such an extent that the bonded first and second sheet sections exhibit a peeling strength of up to 200 g/25 mm, determined at a peeling angle of 180° and are separable from each other by hand, the separated sheets being free of pressure-sensitive properties.

16. The recording composite sheet as claimed in claim 15, wherein the total thickness of the combined sheet sections is 100 to 300 $\mu$m.

17. The recording composite sheet as claimed in claim 15, wherein each sheet section has a thickness of 30 to 300 $\mu$m.

18. The recording composite sheet as claimed in claim 15, wherein the additional recording layer is capable of receiving at least one member selected from thermally transferred sublimating dyes, thermally transferred ink melts and ink jets.

* * * * *